US005306046A

United States Patent [19]

Stanley

[11] Patent Number: 5,306,046

[45] Date of Patent: Apr. 26, 1994

[54] SKI POLE SECURITY SYSTEM

[76] Inventor: Edward (Bud) Stanley, 160 Bartemus Ter., Nashua, N.H. 03063

[21] Appl. No.: 887,329

[22] Filed: May 22, 1992

[51] Int. Cl.[5] ..... A63C 11/22

[52] U.S. Cl. ..... 280/819; 280/820; 280/821; 70/30; 70/58

[58] Field of Search ..... 280/809, 816, 819, 820, 280/821, 814; 70/30, 58, 59

[56] References Cited

U.S. PATENT DOCUMENTS 3,335,585 8/1967 Stratton ..... 280/814
4,234,202 11/1980 Loffelholz ..... 280/820
4,585,252 4/1986 Cooke ..... 280/820
4,597,273 7/1986 Reichenberger ..... 280/814
5,063,762 11/1991 Vandeweghe ..... 280/820

*Primary Examiner*—Richard M. Camby
*Attorney, Agent, or Firm*—Blodgett & Blodgett

[57] ABSTRACT

A ski pole with automatic retractable mechanism for securing ski equipment and preventing theft. The retractor mechanism has a ratchet mechanism in which a gear is fixed to a rotatable spool on which is wound a security line and a pawl which is positioned to engage the gear and to provide a step-wise rotation of the spool. This serves to unwind the security line from the spool. The security line is rewound onto the spool by a spring which extends downward into the hollow interior of the ski pole shaft.

6 Claims, 5 Drawing Sheets

SKI POLE SECURITY SYSTEM

FIELD OF INVENTION

This invention is an integral ski pole and ski equipment lock.

BACKGROUND OF THE INVENTION

The present invention is directed generally to securing a pair of skis and poles from theft by an automatically retractable security line stored within the handle of a ski pole.

In the normal course of a day's skiing it is common for a skier to leave his ski equipment unattended temporarily while he enters a ski lodge or buildings to purchase a lift ticket, eat lunch, or rest. At such times, ski equipment may be placed on a rack or leaned against a tree. Often, this equipment may be stolen or accidentally removed if it is left in such positions unsecured. A means to protect such theft or ski removal is, therefore, desirable.

Coin operated lockers and racks are available for skiers to secure their ski equipment. Such devices, however, can be inconvenient and costly.

Various portable locking devices are available which may be carried by a skier. However, due to the weight or inconvenience of carrying such devices, most skiers would prefer a more simplistic device or solution.

Few security systems provide a streamlined cost effective and efficient means for locking and temporarily storing ones ski equipment. In addition, none of the prior art discloses such a security system which utilizes an automatic retractor mechanism to store a security line interior to a ski pole grip housing.

It is therefore an outstanding object of the present invention to provide a ski pole which utilizes an automatic retractor mechanism to store a security line interior to a ski pole grip housing.

Another object of the present invention is to provide a cost effective and convenient security system which will prevent theft and not require a skier to carry any additional or cumbersome parts.

A still further object of the present invention is to provide a ski pole retractor mechanism which will allow for step wise advancement of a security line when it is pulled from the interior of the ski pole grip housing.

With these and other objects in view, as will be apparent to those skilled in the art, the invention resides in the combination of parts set forth in the specification and covered by the claims appended hereto.

SUMMARY OF THE INVENTION

In general the invention is a ski pole comprising a grip housing including a chamber and handle. An elongated shaft is disposed in the grip housing and in contact with the chamber. A lock head is fixed to a security line and the security line is attached to a retractor mechanism which is disposed in the grip housing. A cap is fixed on the grip housing and in contact with the grip housing chamber to protect the retractor mechanism and seal the chamber from the exterior. A lock housing is fixed to the ski pole shaft and grip housing handle.

DESCRIPTION OF THE PREFERRED EMBODIMENT

Figure 1:
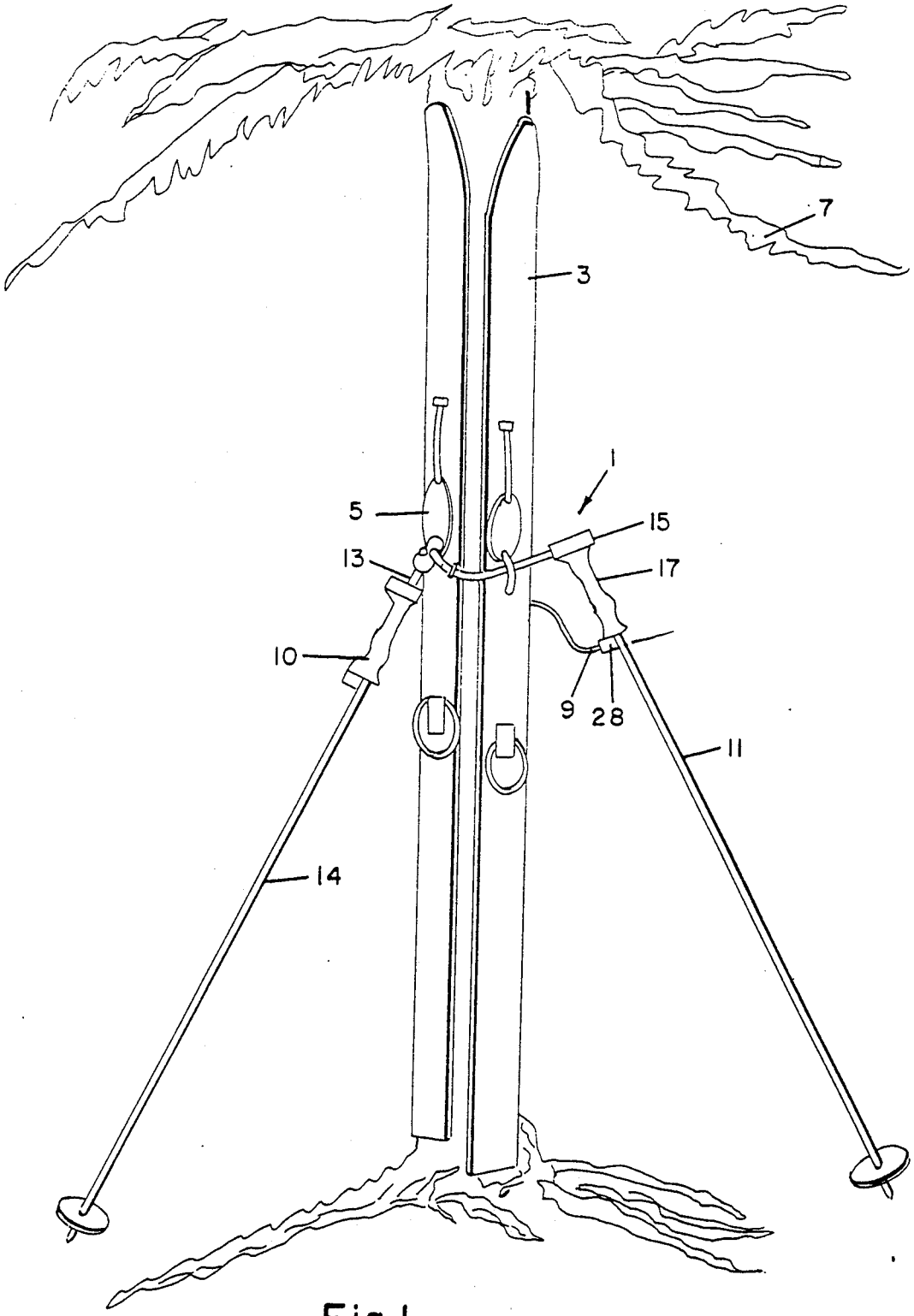
FIG. 1 is a front elevational view of the ski pole and extended security line secured to a tree.

Referring first to FIG. 1, the ski pole security system is generally indicated by the reference numeral 1. A security line 9 may be pulled from a ski pole grip housing 17 and woven through a pair of skis 3, ski bindings 5 or ski straps 13. The lock head 15 (not shown in FIG. 1) may then be wrapped around a tree 7 and inserted into a lock housing 28 which may be located on either ski pole grip housing 17 to form a secured and closed loop.

Figure 2:
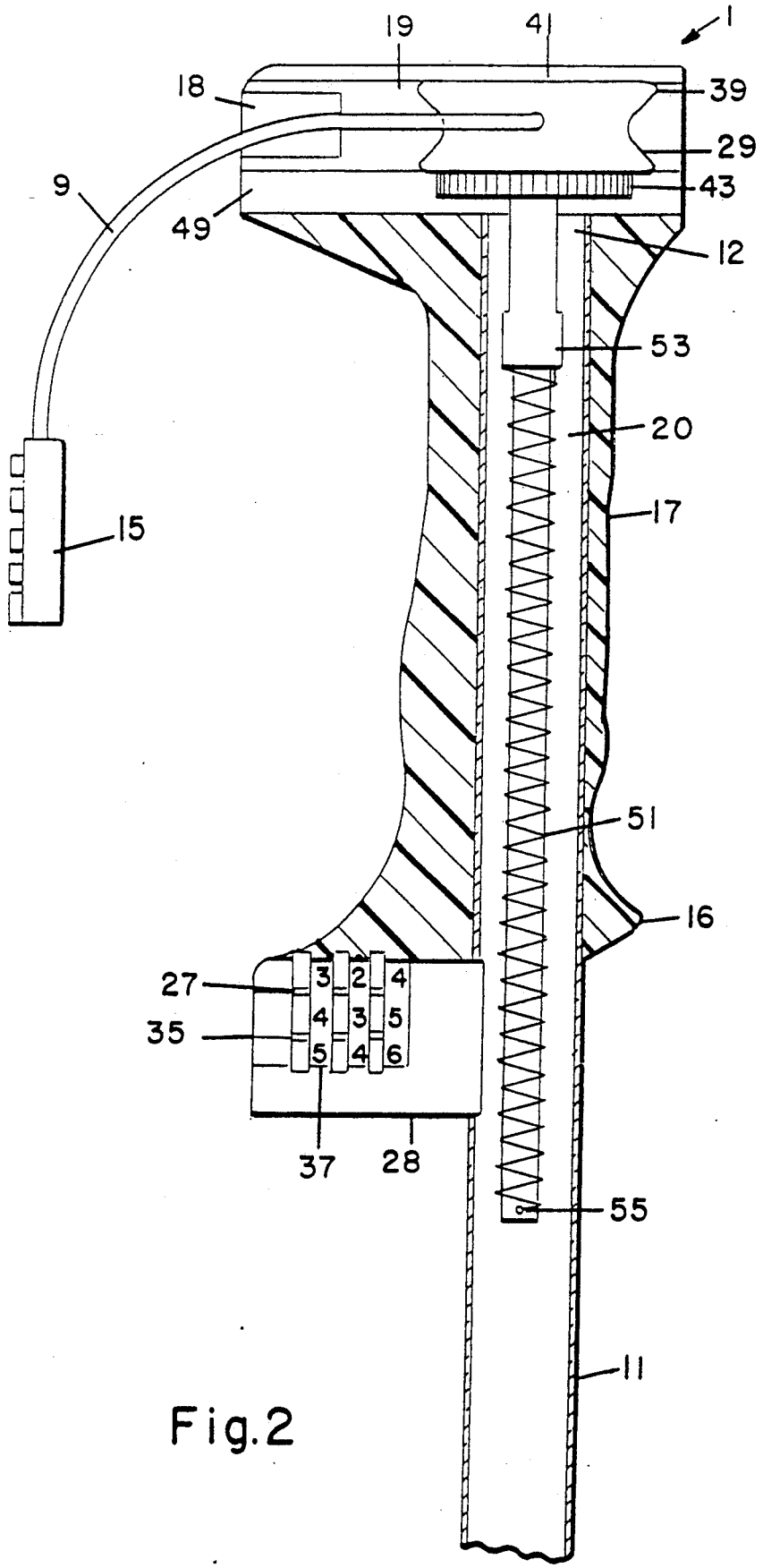
FIG. 2 is a cross-sectional view taken along I—I and showing the retractor mechanism in relation to the ski pole grip housing.
Figure 3:
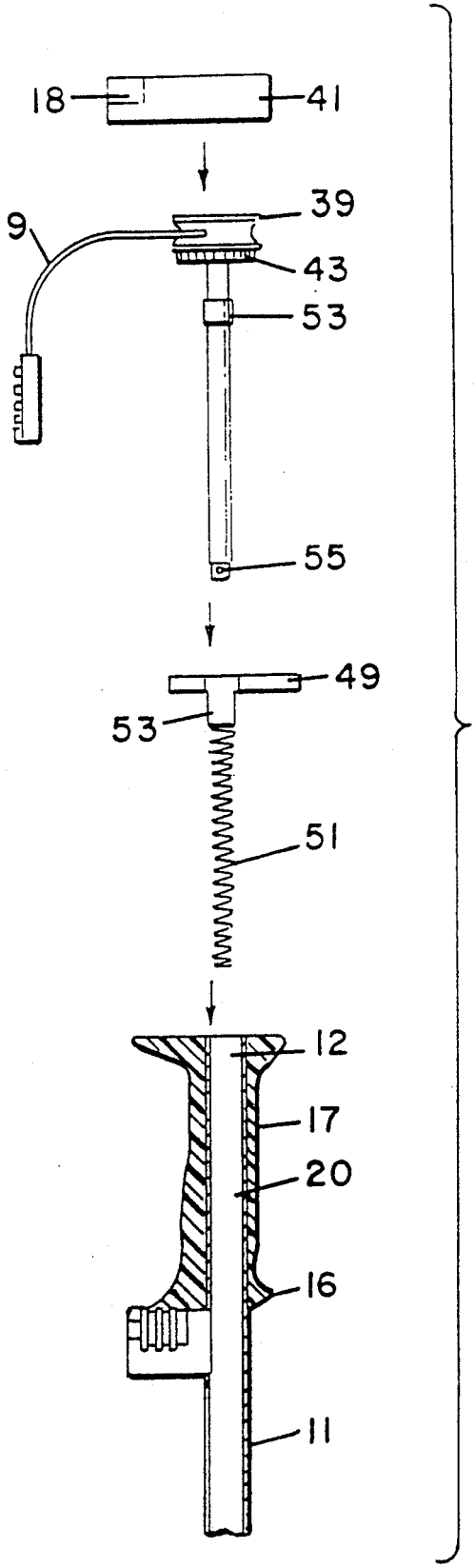
FIG. 3 is an exploded view of the present invention and how its parts relate to the ski pole grip housing.
Figure 4:
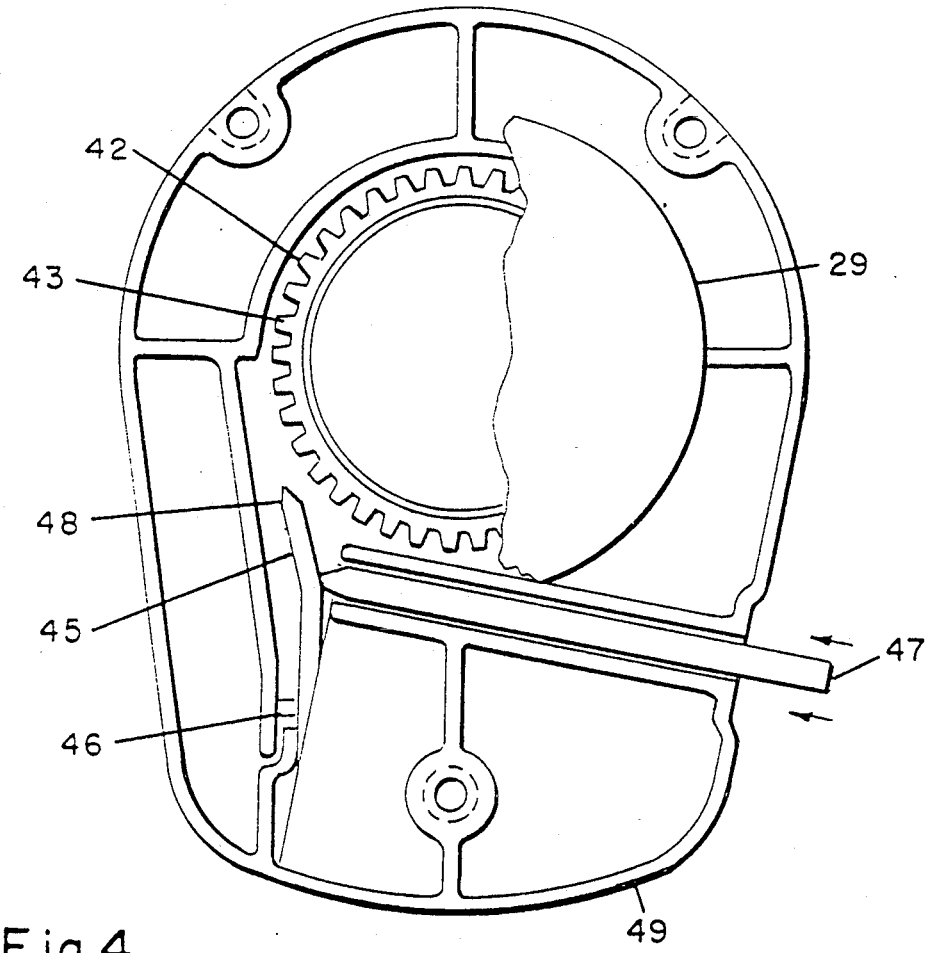
FIG. 4 is a plan view of the base plate looking downward as the plate would be positioned on the handle of the ski pole grip housing and shows the pawl, gear and button are oriented when the button is depressed.
Figure 7:
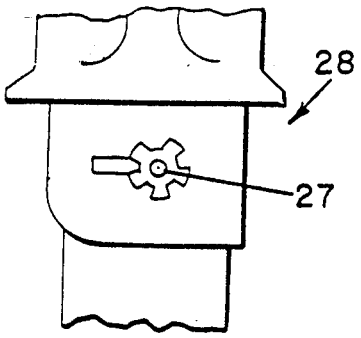
FIG. 7 is a side elevation view of the lock housing showing the lock housing passageway for the lock head.

Referring now to FIGS. 2–3, the ski pole comprises a ski pole grip housing 17 having a hollow interior 20. The grip housing 17 includes a chamber 19 at one end and a handle 16 at the other end. An elongated ski pole shaft 11 is disposed in the grip housing 17 and has a first end 12 in contact with the grip housing chamber 19. A length of security line 9 is fixed to a lock head 15 on one end and a retractor mechanism disposed in the housing chamber 19 on the other. The housing chamber 19 has an opening 18 to allow a skier to extend the security line 9 from the grip housing 17. A ski pole grip cap 41 may be fixed in the grip housing 17 and in contact with the grip housing chamber 19 to protect the retractor mechanism and seal the housing chamber 19 from the exterior. A lock housing may be fixed to the elongated ski pole shaft 11 and grip housing handle 16 having the retractor mechanism or fixed to the other ski pole shaft 14 and housing handle 10 (not shown in FIG. 2–3). The lock housing 28 (as shown in FIG. 7) has a passageway 27 for receiving the lock head 15 in a selective releasing and locking relationship. The preferred embodiment of the lock housing 28 utilizes a tumbler pin 35 and rotatable numeral plates 37 to close the passageway 27 and permanently engage the lock head 15.

The retractor mechanisms preferred embodiment comprises a rotatable spool 29 and a ratchet mechanism. The ratchet mechanism is in contact with the rotatable spool 29 to provide a step wise advancement of the security line 9 when it is extended from the grip housing 17. A biasing means is fixed to the ratchet mechanism and extends down into the elongated ski pole shaft 11. The biasing means preferred embodiment comprises a rod 53 with fastening hole 55 which is attached to a ratchet mechanism and threaded by means of the hole 55 to a spring 51 attached to a base plate 49 which abuts the ski pole grip housing 17.

Referring to FIGS. 4–9, the ratchet mechanisms preferred embodiment comprises a gear 43 having teeth 42 fixed to a rotatable spool 29 with a flange 39 to store the security line 9. A pawl 45 having a first end 46 disposed in the grip housing 17 and a second end 48 associated with the gear teeth 42. A button 47 is disposed in the grip housing 17 and acts as a means to engage or to disengage the pawl 45 from the gear teeth 42. In the preferred embodiment, the compressed button 47 (see FIG. 4) will disengage the pawl 45 from the gear teeth 42. A biasing means 31 will then automatically rewind the security line 9 upon the rotatable spool 29.

Figure 5:
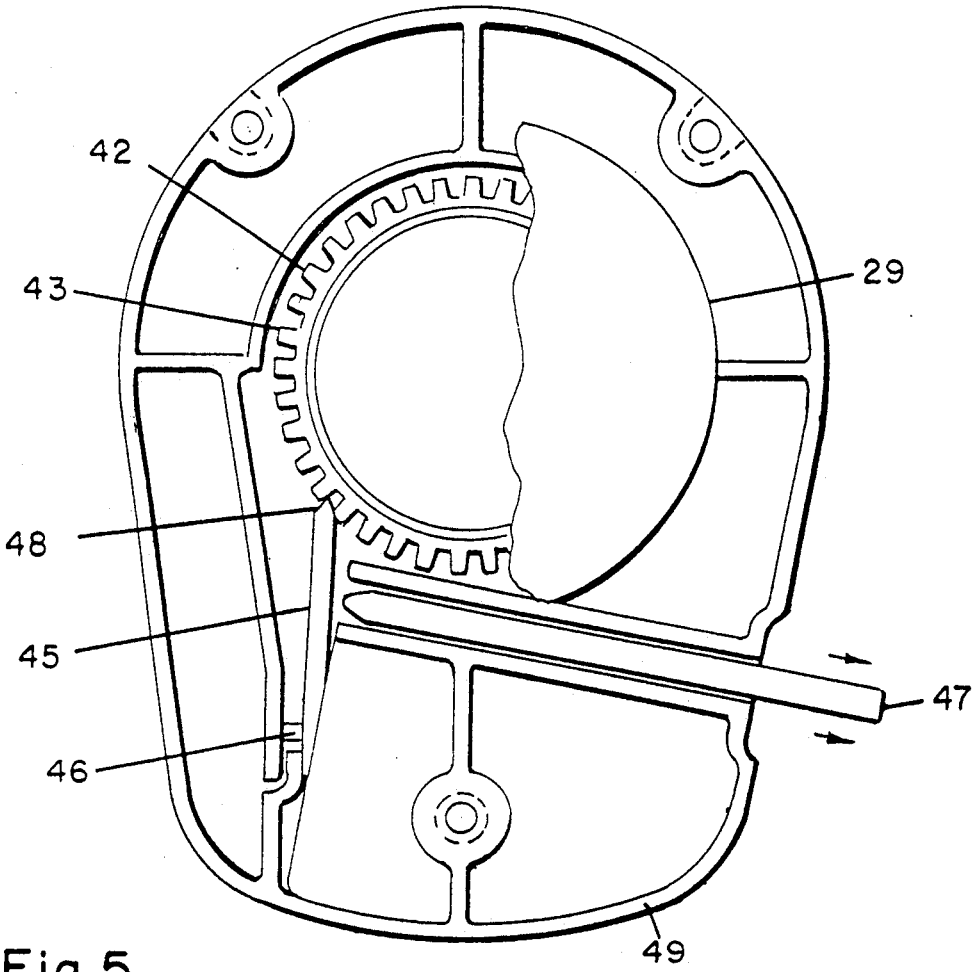
FIG. 5 is the same plan view, but with button in non-depressed position and pawl in the engagement mode with the teeth of the gear.

FIG. 5 shows the position of the button 47 in relation to the pawl 45 in the security line extension mode. As a user extends the security line 9 (not shown), the rotatable spool 29 is rotated. The rotatable spool 29 which is attached to the gear 43 advances the gear 43 and rod 53 (not shown in FIG. 5) which is perpendicular to the spool 29 and gear 43 and extends downward into the grip housing 17 and elongated ski pole shift 11. As the rod 53 rotates with the spool 29 and gear 43, a spring 51 is wound which provides a tension. The tension is maintained by means of the pawl 45 which engages the gear teeth 42 in a step wise fashion when the spool 29 and gear 43 are rotated.

Figure 6:
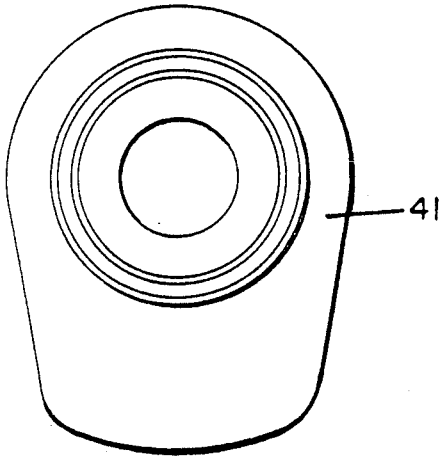
FIG. 6 is a top plan view of the ski pole grip cap which covers the ski pole grip housing chamber and seals the retractor mechanism and chamber from the exterior.
Figure 9:
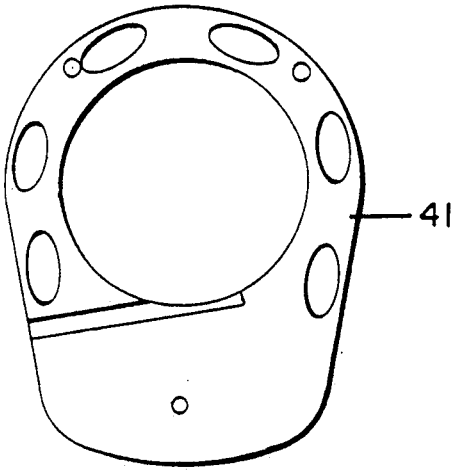
FIG. 9 is a plan view of the bottom of the ski pole cap which covers the ski pole grip housing chamber and seals the retractor mechanism and chamber from the exterior.
Figure 8:
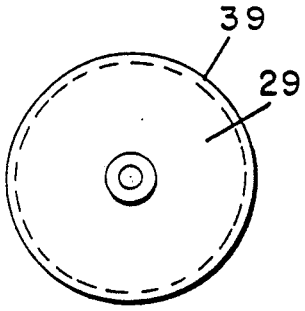
FIG. 8 is a top plan view of the rotatable spool which stores the security line.

FIG. 3 particularly shows the general construction of the preferred embodiment. The spring 51 is attached to the base plate 49 to form a single piece which is first inserted into the ski pole grip housing 17. The spool 29, gear 43, rod 53 and lock head 15 are attached to form a second piece which is inserted to sit flush up against the base plate 44 and ski pole grip housing 17. The rod 53 must be designed long enough so that a small portion will protrude below the spring 51, when the rod 53 is inserted into the spring 51 and base plate 49. This will allow for the edge of the spring 51 to be inserted into the fastening hole in the rod 55. A ski pole grip cap 41 (as shown in FIG. 6 and FIG. 9), is then fixed on the grip housing 17 and in contact with the grip housing chamber 19 to protect the retractor mechanism and seal the chamber 14 from the exterior.

Clearly, minor changes may be made in the form and construction of the invention without departing from the material spirit thereof. It is not, however, desired to confine the invention to the exact form herein shown and described, but it is desired to include all such as properly come within the scope claimed.

The invention having thus been described, what is claimed as new and desired to secure as Letters Patent is:

1. A ski pole, comprising:

(a) a grip housing having a hollow interior, said housing including a chamber at one end and a handle at the opposite end, (b) an elongated ski pole shaft having a first end in contact with said chamber, (c) a security line, (d) a lock head fixed to one end of said security line, (e) a retractor mechanism disposed in said housing chamber and extending into said elongated ski pole shaft, said retractor mechanism being fixed to the other end of said security line and comprising:

(1) a rotatable spool to store said security line, (2) a ratchet mechanism in contact with said rotatable spool, said ratchet mechanism providing a step-wise advancement of said security line when it is extended from said grip housing, said ratchet mechanism comprising a toothed gear which is fixed to said rotatable spool, a pawl having a first end which is disposed in said grip housing and a second end which is associated with said gear teeth, and a button which is disposed in said grip housing for engaging and disengaging said pawl from the teeth of said gear, and (3) biasing means fixed to said ratchet mechanism and extending down into said elongated ski pole shaft, so that when said spool is forcibly rotated in one direction said biasing means will maintain a tension, (f) a ski pole grip cap which is fixed to said grip housing and which is in contact with said grip housing chamber to protect said retractor mechanism and to seal said chamber from the exterior, and (g) a lock housing which is fixed to said ski pole handle, said lock housing having a passageway for receiving said lock head in a selective releasing and locking arrangement.

2. A ski pole as recited in claim 1, in which said lock housing utilizes a tumbler pin and a series of rotatable numeral plates for engaging said tumbler pin and for closing said passageway and permanently engaging said lock head.

3. A ski pole as recited in claim 1, in which said biasing means further comprises:

(a) a rod with a hole, said rod fixed to said ratchet mechanism, and (b) a spring fixed to said rod by means of said hole.

4. A ski pole as recited in claim 1, in which the security line is a cable.

5. A ski pole as recited in claim 1, in which said security line is a cord.

6. A ski pole, comprising:

(a) a grip housing having a hollow interior, said housing including a chamber at one end and a handle at the opposite end, (b) an elongated ski pole shaft having a first end in contact with said chamber, (c) a security line, (d) a lock head which is fixed to one end of said security line, (e) a retractor mechanism which is disposed in said housing chamber and which extends into said elongated ski pole shaft, said retractor mechanism being fixed to the other end of said security line, and further comprising: a spool which is rotatably mounted within said grip housing for storing said security line, biasing means for rotating said spool in a first direction for winding said security line onto said spool, a ratchet mechanism which is in contact with said rotatable spool, said ratchet mechanism providing for a step-wise rotation of said spool in a second direction which is opposite said first direction for unwinding said security line from said spool, (f) a ski pole grip cap which is fixed to said grip housing and in contact with said grip housing chamber to protect said retractor mechanism and to seal said chamber from the exterior, and (g) a lock housing fixed to said ski pole handle, said housing having a passageway for receiving said lock head in a selective releasing and locking arrangement.

* * * * *